US011040819B1

(12) United States Patent
Frankcomb

(10) Patent No.: US 11,040,819 B1
(45) Date of Patent: Jun. 22, 2021

(54) INSULATED HOLDER FOR A BEVERAGE CONTAINER

(71) Applicant: Rose Dorothy Frankcomb, Armadale (AU)

(72) Inventor: Rose Dorothy Frankcomb, Armadale (AU)

( * ) Notice: Subject to any disclaimer, the term of this patent is extended or adjusted under 35 U.S.C. 154(b) by 0 days.

(21) Appl. No.: 17/124,882

(22) Filed: Dec. 17, 2020

(51) Int. Cl.
*B65D 81/38* (2006.01)
*A47G 23/02* (2006.01)
*B67B 7/16* (2006.01)

(52) U.S. Cl.
CPC ..... *B65D 81/3881* (2013.01); *A47G 23/0241* (2013.01); *B67B 7/16* (2013.01); *A47G 2023/0283* (2013.01)

(58) Field of Classification Search
CPC ..... B65D 81/3881; A47G 23/0241; A47G 2023/0283; B67B 7/16
See application file for complete search history.

(56) References Cited

U.S. PATENT DOCUMENTS

| | | | | |
|---|---|---|---|---|
| 7,343,834 | B2 * | 3/2008 | Howlett | A47G 23/0216 215/390 |
| D752,397 | S | 3/2016 | Seiders et al. | |
| D780,530 | S | 3/2017 | Seiders et al. | |
| 10,251,468 | B1 * | 4/2019 | Moore | B65D 41/58 |
| 2007/0074604 | A1 * | 4/2007 | Lipson | B67B 7/16 81/3.15 |
| 2014/0166672 | A1 * | 6/2014 | Stroucken | F25D 3/08 220/592.01 |
| 2017/0095120 | A1 * | 4/2017 | Tolman | B65D 25/2817 |
| 2018/0242765 | A1 * | 8/2018 | Rane | A47G 23/0241 |
| 2019/0082872 | A1 * | 3/2019 | Wortham | A47G 23/0216 |

* cited by examiner

*Primary Examiner* — Don M Anderson
(74) *Attorney, Agent, or Firm* — Eric Karich; Karich & Associates

(57) ABSTRACT

An insulated holder for a beverage container has a thermally insulating main body with a base and an upwardly extending side wall that extends upwardly to a top perimeter opening, wherein the top perimeter opening allows access to an interior chamber formed by the main body. The interior chamber is adapted to receive the beverage container, and an opening is formed in a bottom surface of the base, wherein a bottle opener prong extends laterally into the opening.

10 Claims, 5 Drawing Sheets

INSULATED HOLDER FOR A BEVERAGE CONTAINER

BACKGROUND OF THE INVENTION

Field of the Invention

This invention relates to an insulated holder for a beverage container, and more particularly to an insulated holder that includes an integral bottle opener.

Description of Related Art

The prior art teaches many forms of insulated holders for beverage containers. Common holders, include products sold under the names Koozie® and Coldster®, are used to keep the beverage (e.g., can or bottle) cold for a longer period of time, especially in a hot environment.

The prior art teaches the general construction of an insulated holder for holding a beverage container. However, the prior art does not teach such an insulated holder that includes a bottle opener built into the bottom. The present invention fulfills these needs and provides further advantages as described in the following summary.

SUMMARY OF THE INVENTION

The present invention teaches certain benefits in construction and use which give rise to the objectives described below.

The present invention provides an insulated holder for a beverage container, the insulated holder comprising a thermally insulating main body having a base and an upwardly extending side wall that extends upwardly to a top perimeter opening, wherein the top perimeter opening allows access to an interior chamber formed by the main body. The interior chamber is adapted to receive the beverage container, and an opening is formed in a bottom surface of the base, wherein a bottle opener prong extends laterally into the opening.

A primary objective of the present invention is to provide an insulated holder having advantages not taught by the prior art.

Another objective is to provide an insulated holder that includes an interior chamber adapted to contain a beverage container.

A further objective is to provide an insulated holder that includes a bottle opening function.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, an insulated holder for a beverage container that is also adapted to open bottle caps.

Figure 1:
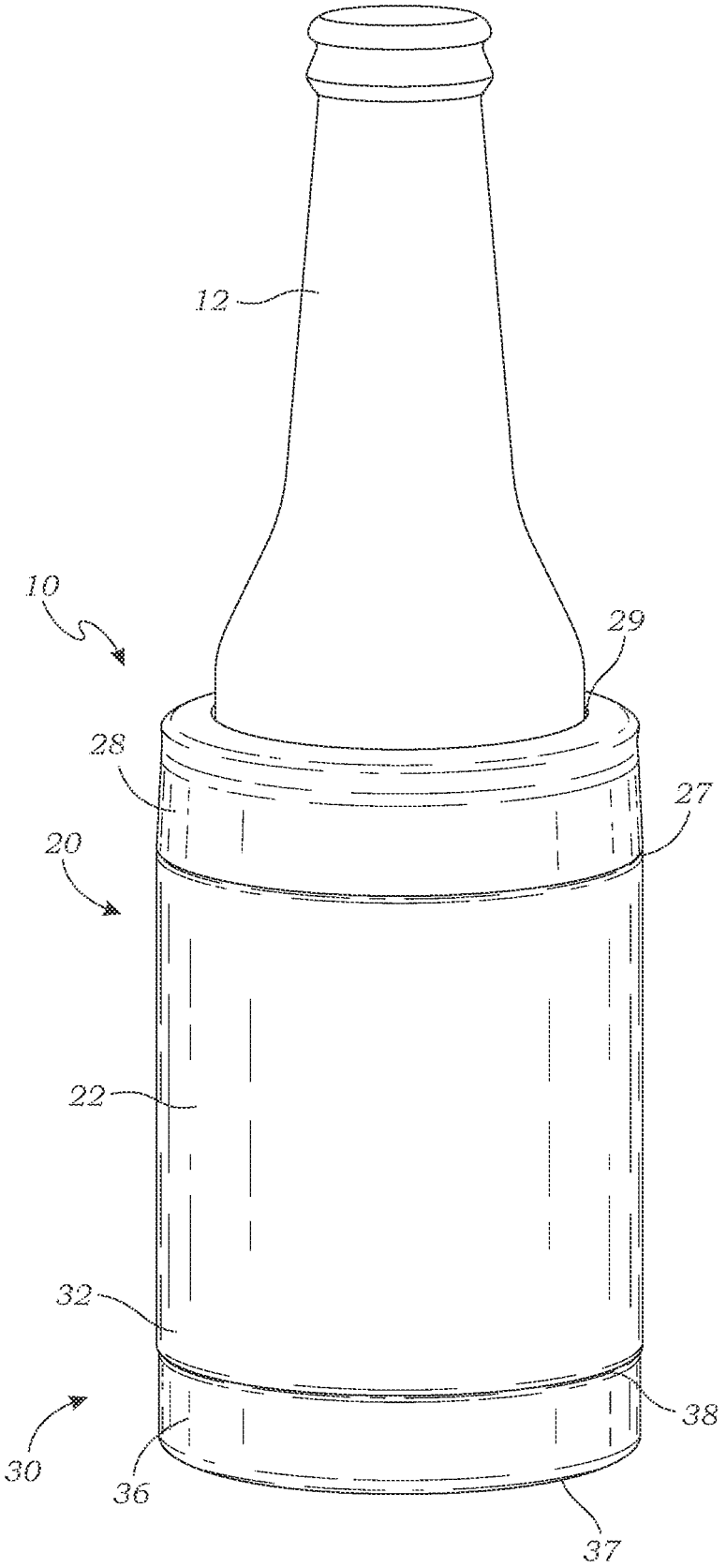
FIG. 1 is a top perspective view of an insulated holder for a beverage container according to one embodiment of the present invention and showing a bottle in the insulated holder.
Figure 2:
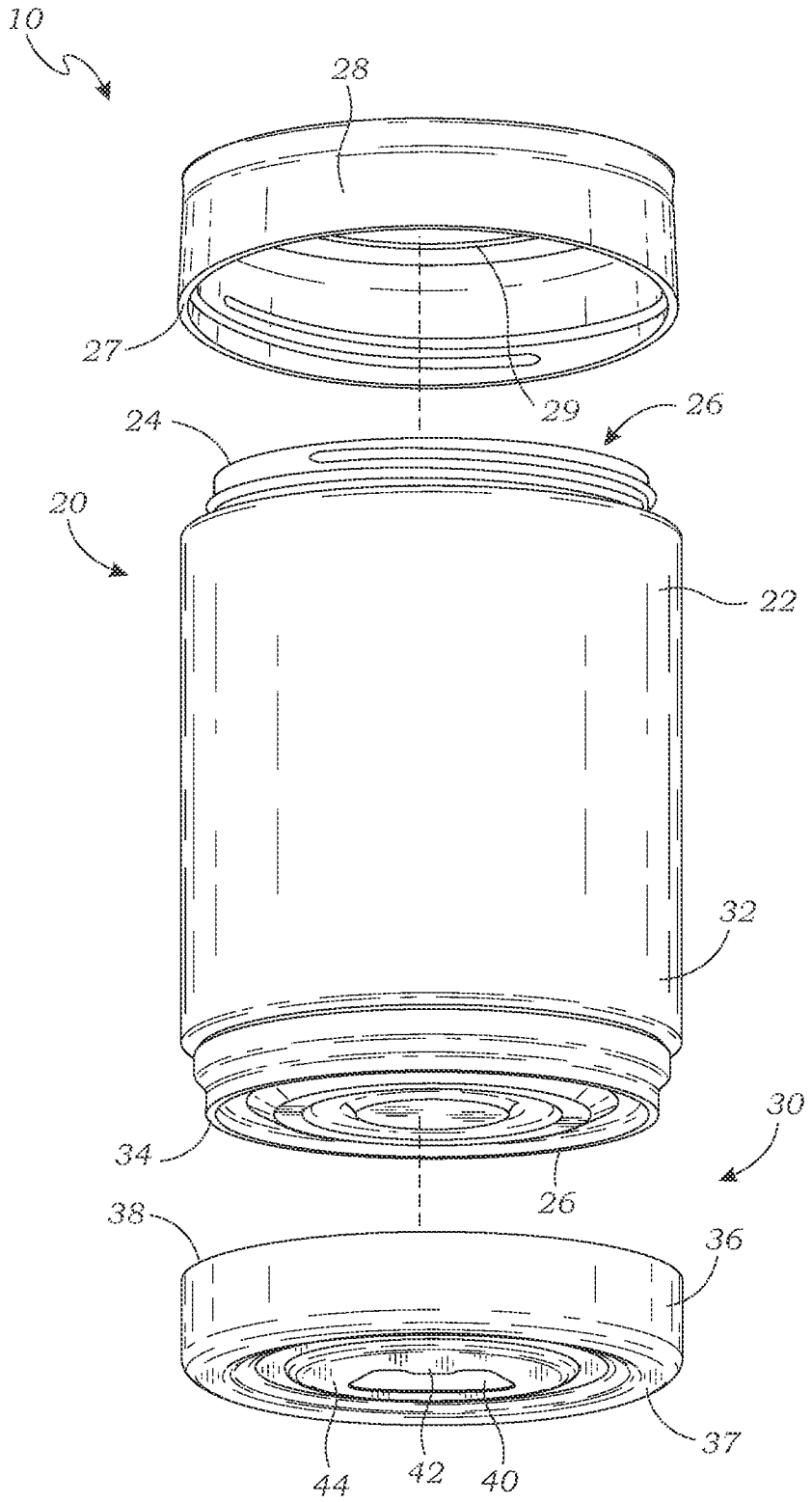
FIG. 2 is an exploded bottom perspective view thereof, without the bottle.

FIG. 1 is a top perspective view of an insulated holder for a beverage container 10 according to one embodiment of the present invention and showing a bottle 12 in the insulated holder 10, and FIG. 2 is an exploded bottom perspective view thereof, without the bottle 12. As shown in FIGS. 1-2, the insulated holder 10 comprises a thermally insulating main body 20 adapted to contain the beverage container 12 (such as the bottle or a can), and further having a base 30 that is adapted to open bottle caps, discussed below.

The insulating main body 20 has an upwardly extending side wall 22 that extends upwardly to a top perimeter opening 24, wherein the top perimeter opening 24 allows access to an interior chamber 26 formed by the main body 20, and the interior chamber 26 is adapted to receive the beverage container 12. In some embodiments, the main body 20 has a double-walled construction having an inner wall 23 that is spaced apart from the upwardly extending side wall 22 to form an air gap therebetween, for insulating the beverage container 12 within the interior chamber 26. The inner and outer walls 22 and 23 may be generally parallel to each other, and the air gap 25 is a suitable width for insulation within the interior chamber 26.

As shown in FIG. 2, the top perimeter opening 24 of the insulated holder 10 may be adapted to removably attach to a bottom perimeter 27 of a top cap 28, the top cap 28 further having an upper aperture 29 that is wide enough to allow access to drink from the beverage container 12 while attached to the main body 20. For example, a user may remove the top cap 28, place the beverage container 12 inside the main body 20 of the insulated holder 10, and then replace the top cap 28 to secure the beverage container 12 in place, wherein the beverage container 12 may extend upwardly through the upper aperture 29 and past the top cap 28. In this embodiment, the top cap 28 may be adapted to threadedly engage the top perimeter opening 24, but in other embodiments may attach via another means (e.g., welding, frictional engagement, snap closures, etc.). In some embodiments, the top perimeter opening 24 may be without threads or attachment means, and be provided without the top cap 28.

In this embodiment, the base 30 includes an integral bottom portion 32 of the main body 20, and a bottom cap 36 separate from the integral bottom portion 32, which includes a cap perimeter 38 that is attached to a bottom perimeter 34 of the integral bottom portion 32. In other implementations, the base 30 may comprise only the integral bottom portion 32. As shown in FIG. 1, the cap perimeter 38 is spin welded to the bottom perimeter 34 of the integral bottom portion 32, but in alternative embodiments the cap perimeter 38 may be threadedly engaged or otherwise bonded to the bottom perimeter 34 of the integral bottom portion 32, or be attached via any other means known in the art. The base of the insulated holder 10 further includes a bottle cap opening function, the structure of which is best shown in FIGS. 4-5 and discussed below.

Figure 3:
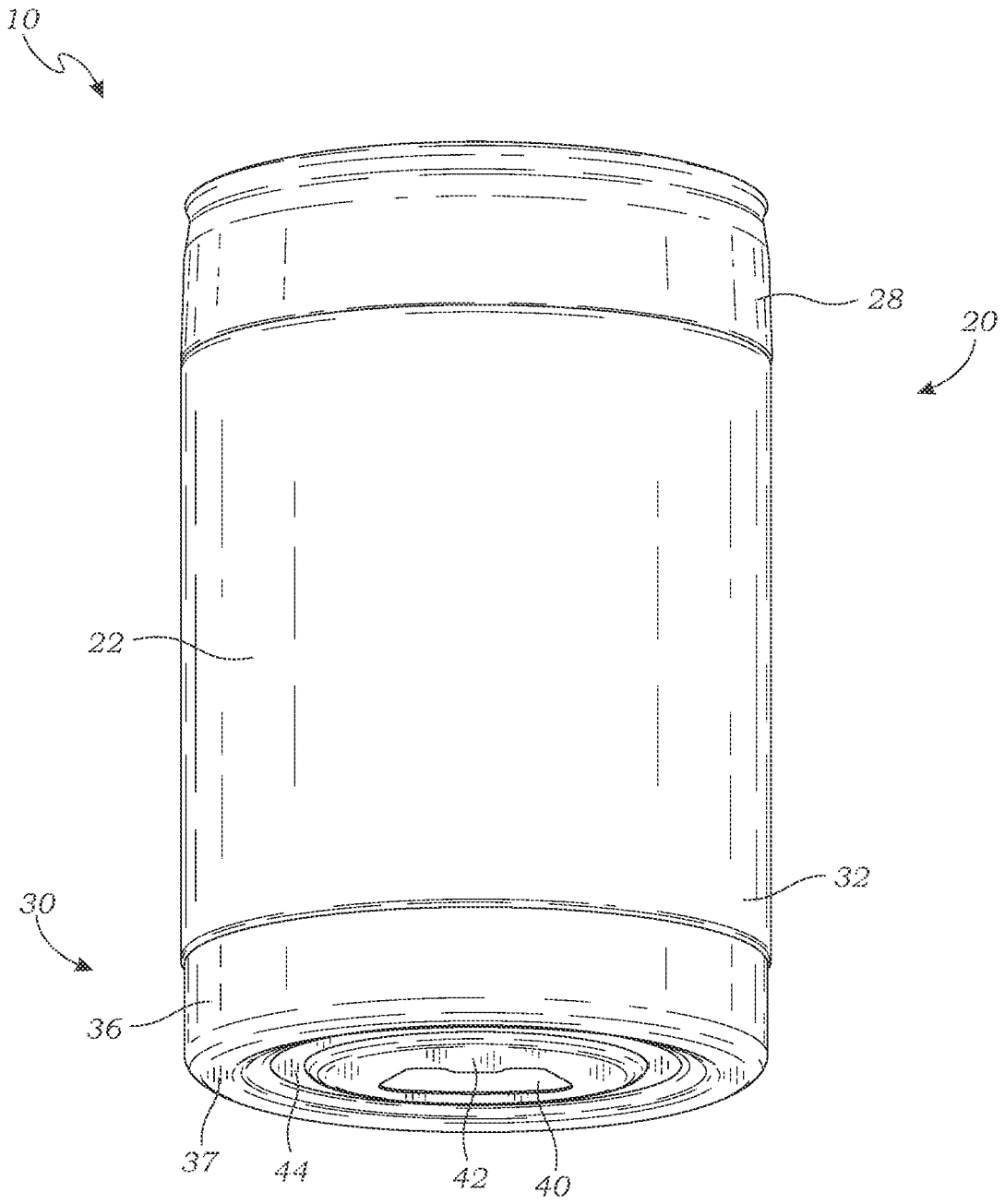
FIG. 3 is a constructed bottom perspective view thereof.
Figure 4:
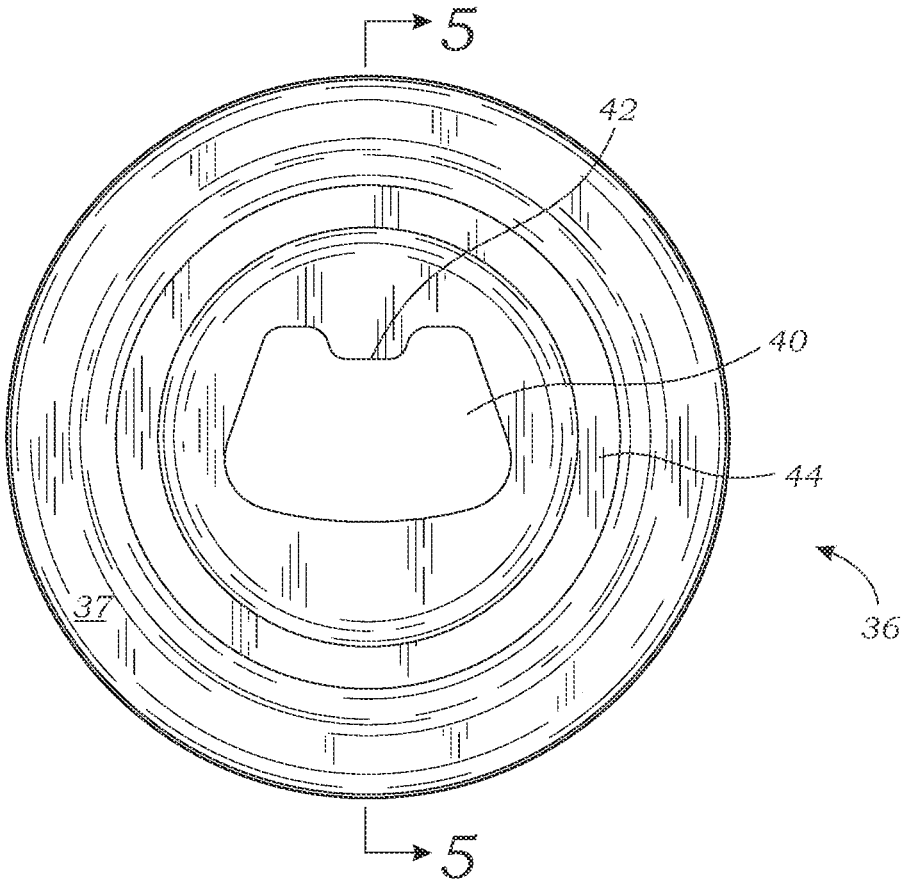
FIG. 4 is a bottom plan view thereof.
Figure 5:
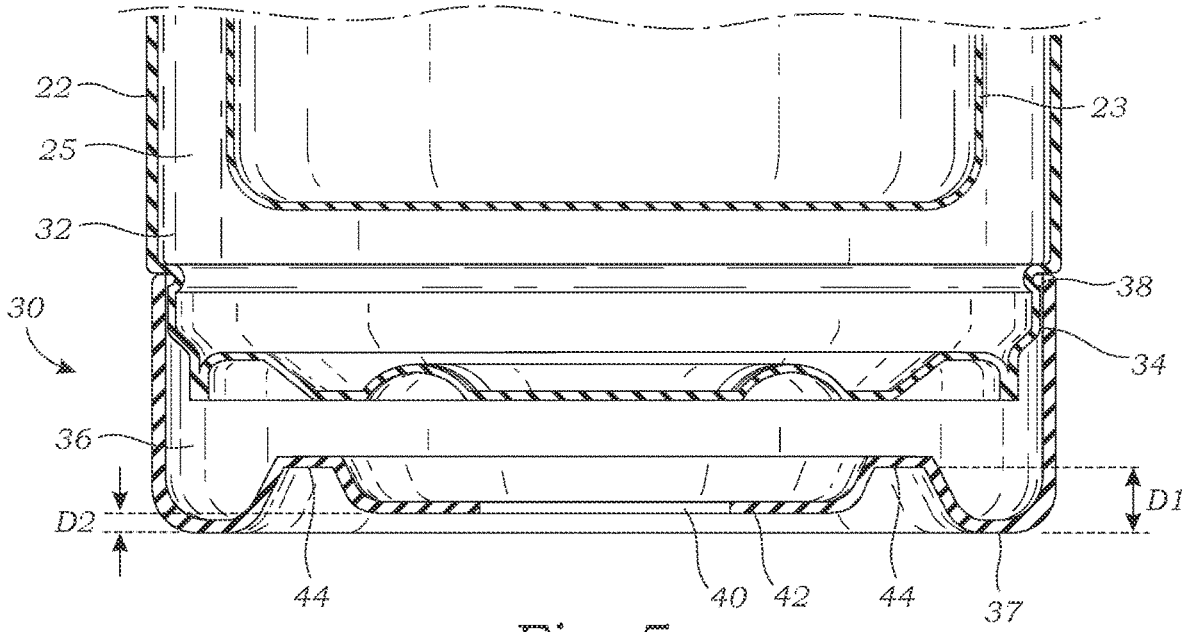
FIG. 5 is a sectional view thereof taken along line 5-5 in FIG. 4.

FIG. 3 is a constructed bottom perspective view of the insulated holder 10, FIG. 4 is a bottom plan view thereof, and FIG. 5 is a sectional view thereof taken along line 5-5 in FIG. 4. As shown in FIGS. 3-5, The bottom cap 36 of this embodiment includes an opening 40 on a bottom surface 37 of the bottom cap 36, wherein the opening 40 includes a bottle opener prong 42 that extends into the opening 40. The opening 40 shown is sized and adapted to open a bottle cap using the bottle opener prong 42, i.e., having angles suited to engage standard bottle caps, but the opening 40 may be shaped or sized in any suitable fashion, and may include further features useful for bottle opening (e.g., additional grip material, prongs, ridges, etc.). Because in this embodiment the opening 40 is on the bottom cap 36 and not the integral bottom portion 32, it does not result in a loss of insulation in the interior chamber 26. In this manner, in some cases the bottom cap 36 may be removable for use without the bottle cap function.

In some embodiments, as shown in FIG. 5, a recess 44 may be formed in the bottom surface 37 of the bottom cap 36, surrounding the opening 40, wherein the recess 44 is at a depth that is represented by D1. The opening 40 and bottle opener prong 42 may also recess a distance D2 that is less than D1. Another alternative is shown in FIG. 6, discussed below.

Figure 6:
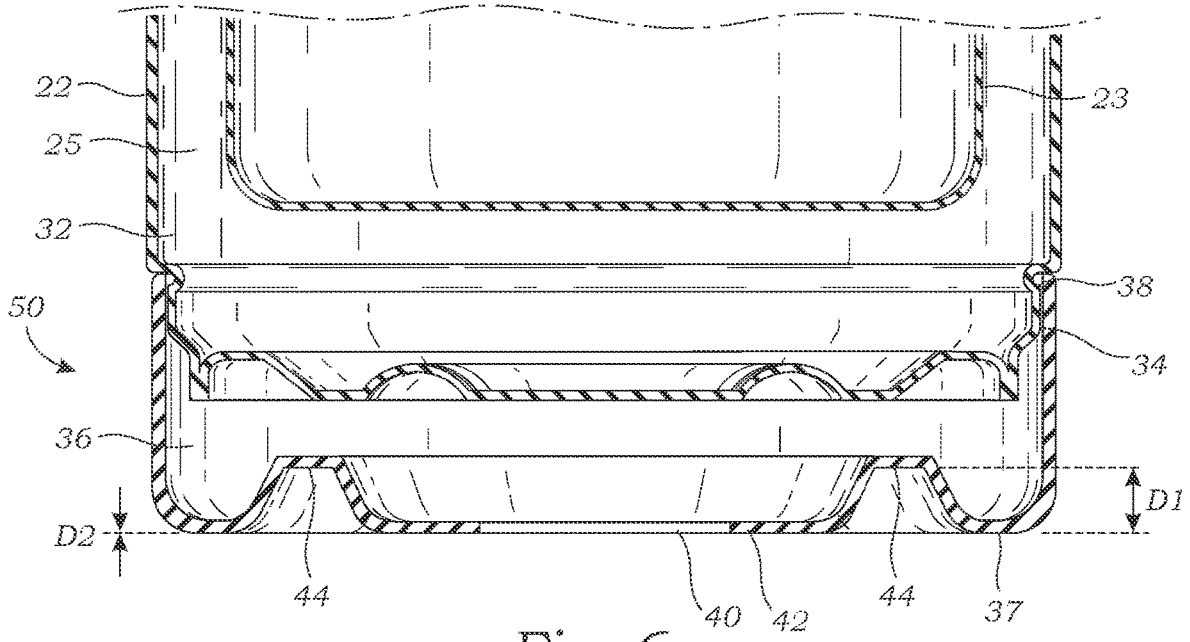
FIG. 6 is a sectional view of another embodiment of the insulated holder.

FIG. 6 is a sectional view of an alternative embodiment of the bottom cap 50 of the insulated holder 10, wherein the opening 40 and bottle opener prong 42 may not recess into the bottom surface 37, as discussed above, and D2 is approximately 0.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. An insulated holder for a beverage container, the insulated holder comprising:

a thermally insulating main body having a base and an upwardly extending side wall that extends upwardly to a top perimeter opening, wherein the top perimeter opening allows access to an interior chamber formed by the main body;

wherein the interior chamber is adapted to receive the beverage container;

an opening formed in a bottom surface of the base;

a recess in the bottom surface surrounding the opening; and a bottle opener prong that extends laterally into the opening.

2. The insulated holder of claim 1, wherein the main body has an inner wall that is spaced apart from the upwardly extending side wall to form an air gap therebetween, for insulating the beverage container within the interior chamber.

3. The insulated holder of claim 1, wherein the top perimeter opening of the insulated holder is adapted to removably attach to a bottom perimeter of a top cap, the top cap further having an upper aperture.

4. The insulated holder of claim 1, wherein the opening is recessed at a depth that is less than the depth of the recess.

5. An insulated holder for a beverage container, the insulated holder comprising:

a thermally insulating main body having a base and an upwardly extending side wall that extends upwardly to a top perimeter opening, wherein the top perimeter opening allows access to an interior chamber formed by the main body;

wherein the interior chamber is adapted to receive the beverage container;

wherein the base includes an integral bottom portion of the main body, and a bottom cap separate from the integral bottom portion, which includes a cap perimeter that is attached to a bottom perimeter of the integral bottom portion;

wherein the bottom cap includes an opening that includes a bottle opener prong that extends into the opening, and wherein a recess is formed in the bottom surface of the bottom cap, surrounding the opening.

6. The insulated holder of claim 5, wherein the cap perimeter of the bottom cap threadedly engages the bottom perimeter of the integral bottom portion.

7. The insulated holder of claim 5, wherein the cap perimeter of the bottom cap is bonded or welded to the bottom perimeter of the integral bottom portion.

8. The insulated holder of claim 5, wherein the main body has an inner wall that is spaced apart from the upwardly extending side wall to form an air gap therebetween, for insulating the beverage container within the interior chamber.

9. The insulated holder of claim 5, wherein the top perimeter opening of the insulated holder is adapted to removably attach to a bottom perimeter of a top cap, the top cap further having an upper aperture.

10. The insulated holder of claim 5, wherein the opening is recessed at a depth that is less than the depth of the recess.

* * * * *